United States Patent [19]

Douthwaite

[11] 4,313,249

[45] Feb. 2, 1982

[54] METHOD OF MANUFACTURING COMPONENTS ADAPTED TO BE MOUNTED ON A SHAFT

[75] Inventor: Donald Douthwaite, Stanford-Le-Hope, England

[73] Assignee: Ford Motor Company, Dearborn, Mich.

[21] Appl. No.: 23,427

[22] Filed: Mar. 23, 1979

[30] Foreign Application Priority Data

Mar. 23, 1978 [GB] United Kingdom ..... 11608/78

[51] Int. Cl.[3] ..... B21D 41/02; B22D 19/04

[52] U.S. Cl. ..... 29/159 B; 29/527.5; 164/98; 164/112

[58] Field of Search ..... 29/527.5, 159 B, 159.3, 29/149.5 R; 164/98, 100, 112; 72/370, 357, 369; 264/265, 269, 275, 276; 74/552

[56] References Cited

U.S. PATENT DOCUMENTS

| | | | |
|---|---|---|---|
| 1,847,414 | 3/1932 | Smith | 29/159 B UX |
| 1,853,583 | 4/1932 | Smith | 29/159 B X |
| 2,033,643 | 3/1936 | Neill | 264/275 |
| 2,463,065 | 3/1949 | Stevenson | 164/324 |
| 2,623,405 | 12/1952 | Sampson | 29/159 B X |
| 2,864,130 | 12/1958 | Beare | 264/276 X |
| 3,125,801 | 3/1964 | Fields | 264/275 X |
| 3,237,480 | 3/1966 | Phelon | 74/552 X |
| 3,950,976 | 4/1976 | DeHove | 72/370 |

FOREIGN PATENT DOCUMENTS

| | | | |
|---|---|---|---|
| 19581 | 5/1977 | Japan | 264/276 |
| 340917 | 1/1931 | United Kingdom | 164/112 |
| 1352120 | 5/1974 | United Kingdom | 74/552 |

*Primary Examiner*—Lowell A. Larson

*Attorney, Agent, or Firm*—Steven L. Permut; Clifford L. Sadler

[57] ABSTRACT

A method of manufacturing a steering wheel or other component adapted to be mounted on a steering wheel includes the steps of placing an insert on a tapered mandrel and deforming the insert by forcing it on the tapered mandrel and moulding the component about the insert when it is engaged on the mandrel.

7 Claims, 5 Drawing Figures

METHOD OF MANUFACTURING COMPONENTS ADAPTED TO BE MOUNTED ON A SHAFT

BACKGROUND OF THE INVENTION

1. Field of the Invention

This invention relates to method of manufacturing components which are adapted to be mounted on shafts particularly for steering shafts of a vehicle.

2. Description of the Prior Art

Conventional die cast components, such as steering wheel hubs, which are adapted to be mounted on a shaft, include a central aperture by means of which the component is attached to the shaft. The internal surface of the aperture is cylindrical and is usually splined so that the component can be non-rotatably fixed to the shaft. Where the end of the shaft is to be fixed in the mounting, part of the internal surface usually diverges outwardly towards the end of the aperture. This diverging surface engages with a complementary surface on the shaft so that the relative axial positions of the component and shaft are fixed.

For reasons of cost, it is desirable to use material other than steel, e.g. aluminum, in the manufacture of components such as steering wheel hubs. However, in some cases, aluminum does not have sufficient strength to permit a direct splined connection between the component and the shaft. Consequently, such components manufactured from aluminum sometimes include a central tubular insert of stronger material, e.g. steel, into which splines can be machined. In the manufacture of such components, the insert is loaded into a die, and the material from which the body of the hub is to be made, e.g. aluminum is then introduced into the die around the insert. In practice, it frequently occurs that the insert is loaded into the die in an incorrect orientation so that the insert is positioned upside-down in the finished component. Where the component is intended to be fixed onto the shaft in one orientation only, the resulting component is useless.

SUMMARY OF THE DISCLOSURE

According to this invention we provide a method of manufacturing a component adapted to be mounted on a shaft which comprises forcing a tubular insert having a substantially uniform internal diameter into engagement with a mandrel having an external surface at least part of which diverges to a diameter greater than the internal diameter of the hub insert, thereby deforming the hub insert so that its internal surface is cylindrical at one end and diverges outwardly towards the other end, moulding a body around the hub insert while the insert is engaged with the mandrel, and disengaging the mandrel and the insert.

Since the divergent part of the insert is not formed until immediately before the body of the component is moulded, the risks of incorporating the insert in the hub in an incorrect orientation are substantially reduced.

The mandrel may be a separate component from the mould and the engagement of the mandrel and insert may be performed as a separate step from loading the mould. In so, the mandrel should be capable of being loaded into the mould in one orientation only. Preferably, however, the mandrel is secured to part of a split mould. and the insert and mandrel are forced into engagement when the split mould is closed.

In order to facilitate the engagement between the divergent surface of the mandrel and the insert, the external surface of the mandrel preferably includes a cylindrical part on which the insert is initially mounted. The insert and the divergent part of the mandrel are then brought into engagement by relative axial movement of the insert and the mandrel.

When the body of the component has been formed around the insert, the mandrel is disengaged from the insert, at which time the insert may be machined if necessary, for example to provide splines on the cylindrical part of its internal surface.

The components produced in accordance with this invention thus comprise a body and a central tubular insert having a substantially uniform wall thickness and an internal surface which is cylindrical at one end and which diverges outwardly towards the other end.

In order to ensure that the insert is fixed firmly within the body, the insert preferably includes one or more grooves or indentations on its external surface which provide a key for the body.

Although the present invention is especially suitable for the manufacture of steering wheel hubs, many other components can be made in accordance with the invention, for example pulley wheels, gear wheels, actuating levers and operating handles.

BRIEF DESCRIPTION OF THE DRAWINGS

Reference now will be made to the following drawings in which.

DETAILED DESCRIPTION OF THE PREFERRED EMBODIMENT

Figure 1:
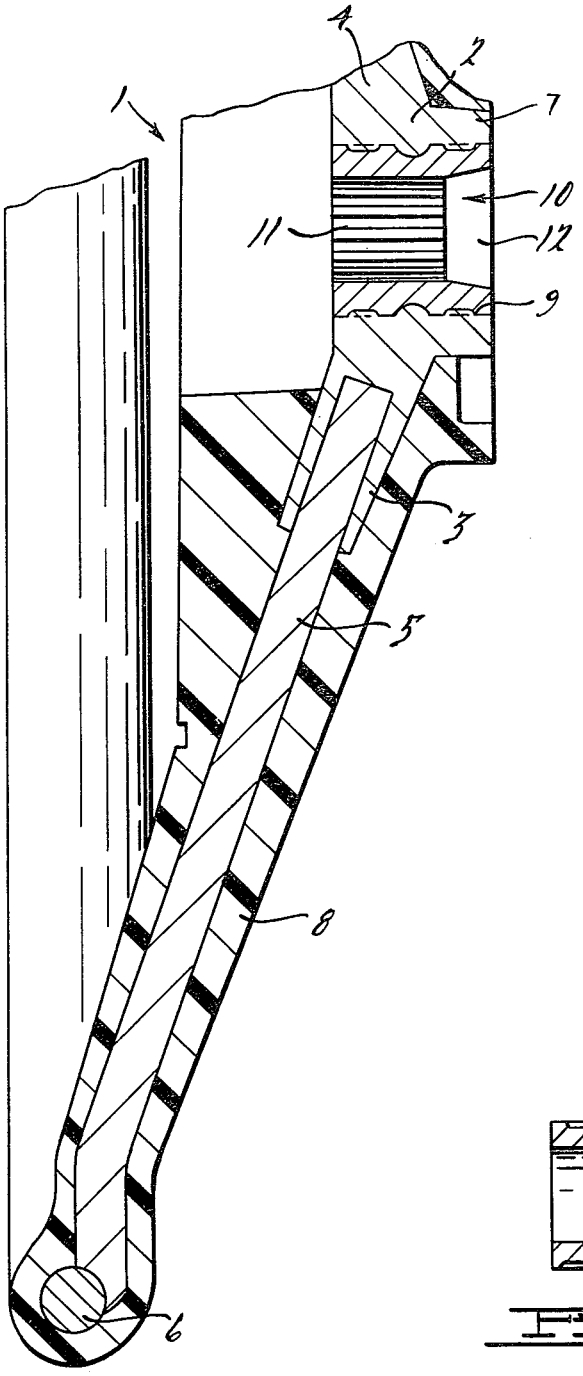
FIG. 1 represents a cross-section through a steering wheel including a conventional hub.

Referring to FIG. 1, a steering wheel 1 comprises a hub 2 carrying mountings 3, 4 for a pair of steering wheel spokes 5 which are in turn connected to a wheel rim 6. The rim, spokes and hub are encased in a covering of plastic material 8.

The hub 2 comprises a body 7 of aluminum and a cylindrical steel insert 9. The insert 9 defines a central aperture 10 the internal surface of which has a cylindrical part 11 and an outwardly diverging part 12. The cylindrical part 11 is splined for engagement with a splined steering column (not shown) which is also shaped to conform to the diverging part 12.

The hub 2 is manufactured by loading the insert 9 into a mould and casting aluminum around the insert. Since the insert 9 has a generally cylindrical external surface it is possible to load the insert into the mould in the incorrect orientation so that, in the finished hub, the divergent part 12 is positioned adjacent the mountings 3, 4.

Figure 2:
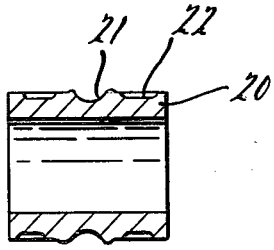
FIG. 2 represents an axial cross-section of a hub insert used in the method of the invention.
Figure 3:
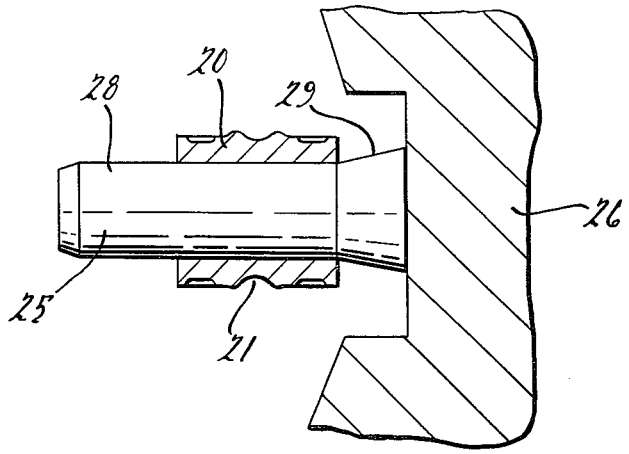
FIGS. 3 and 4 represent two consecutive stages in the method of the invention.
Figure 4:
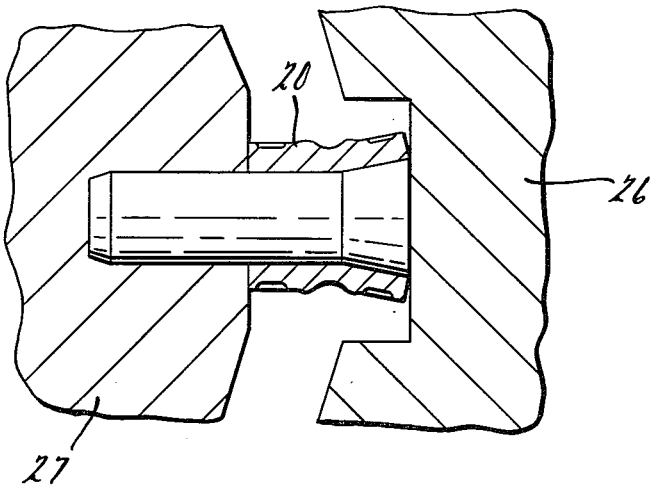

Referring now to FIGS. 2 to 4, steering wheel hubs are manufactured in accordance with this invention using a tubular hub insert 20 which has a substantially uniform internal diameter and wall thickness. The external surface of the insert 20 is provided with a circumferential groove 21 and a series of axial recesses 22 as shown in FIG. 3.

The insert 20 is loaded onto a mandrel 25 which forms part of one section 26 of a split mould, the other section of the mould being indicated at 27 in FIG. 4.

A first part 28 of the mandrel 25 has a cylindrical, external surface and a second part 29 of the mandrel, which is closest to the body of the split mould section 26, has an external surface which diverges to a diameter greater than the internal diameter of the hub insert 20. The axial extent of the second part of the mandrel is less than the axial length of the insert 20.

When the mould sections 26 and 27 are closed, the cylindrical part 28 of the mandrel is received in a recess in the opposite mould section 27 so that the latter mould section causes the insert 20 to move axially along the mandrel 25 and forces the end of the insert 20 into engagement with the divergent part 29 of the mandrel. Thus, as best seen in FIG. 4, the insert 20 is deformed so that its internal surface is cylindrical at one end diverges outwardly towards the other end.

Since the insert 20 has a symmetrical shape until the mould sections are closed, it is not possible to load the insert 20 into the mould in an incorrect orientation. The changes of forming a defective moulding are therefore reduced.

Figure 5:
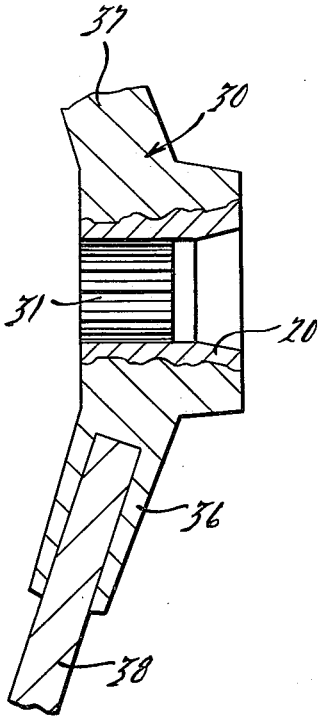
FIG. 5 represents a cross-section through part of a steering wheel incorporating a hub according to the invention.

Molten aluminum is then introduced into the mould to form the body 30 of the hub. The body 30 is assymetrical with respect to a plane transverse to the longitudinal axis of the insert and at the longitudinal midpoint of said insert 20. The groove 21 and recesses 22 key the aluminum into the surface of the insert 20. The mould sections 26, 27 are then separated and the hub is disengaged from the mandrel. Splines 31 can then be machined into the cylindrical part of the internal surface of the insert 20, as illustrated in FIG. 5.

The hub body 30 is of similar shape to the body of the hub of FIG. 1, and includes mountings 36, 37 for spokes 38 which allow the hub to be assembled in a steering wheel in conventional manner.

Variations and modifications of the present invention are possible without departing from its spirit and scope which is defined by the appended claims.

I claim:

1. A method of manufacturing a steering wheel hub component adapted to be mounted on a shaft which comprises the steps of:

forcing a tubular insert having a substantially uniform internal diameter into engagement with a mandrel having an external surface at least part of which diverges to a diameter greater than the internal diameter of the insert;

deforming the insert so that its internal surface is cylindrical at one end and diverges outwardly towards the other end; and moulding a rigid steering wheel hub body around the insert while the insert is engaged with the mandrel such that the body is rigidly connected to the insert and the insert with the divergent surface at one end and the cylindrical surface at another end is properly positioned within the hub body; and disengaging the mandrel and the insert.

2. A method according to claim 1 wherein the mandrel is mounted on one part of a split mould, and the insert and the diverging portion of the mandrel are forced into engagement when the split mould is closed.

3. A method according to claim 1 or claim 2 wherein the insert is mounted on a cylindrical part of the external surface of the mandrel, and the insert and the divergent part of the mandrel are brought into engagement by relative axial movement of the insert and the mandrel.

4. A method according to claims 1 or 2 further comprising the step of forming splines on the cylindrical part of the internal surface of the insert.

5. A method according to claim 3 further comprising the step of forming splines on the cylindrical part of the internal surface of the insert.

6. A method according to claim 1 wherein the steering wheel hub is assymetrical with respect to a plane transverse to the longitudinal axis of the insert and containing the longitudinal midpoint of said insert.

7. A method of manufacturing a component adapted to be mounted on a shaft which comprises the steps of:

forcing a tubular insert having a substantially uniform internal diameter into engagement with a mandrel having an external surface at least part of which diverges to a diameter greater than the internal diameter of the insert;

deforming the insert so that its internal surface is cylindrical at one end and diverges outwardly towards the other end; and moulding a body around the insert while the insert is engaged with the mandrel such that the body is rigidly connected to the insert and the insert with the divergent surface at one end and the cylindrical surface at another end is properly positioned within the body, said body being assymetrical with respect to a plane transverse to the longitudinal axis of the insert and containing the longitudinal midpoint of said insert along said axis; and disengaging the mandrel and the insert.

* * * * *